US006315616B1

(12) United States Patent
Hayashi

(10) Patent No.: US 6,315,616 B1
(45) Date of Patent: Nov. 13, 2001

(54) PLUG CONNECTOR AND SOCKET CONNECTOR

(75) Inventor: Koji Hayashi, Tachikawa (JP)

(73) Assignee: Japan Aviation Electronics Industries, Limited, Tokyo (JP)

( * ) Notice: Subject to any disclaimer, the term of this patent is extended or adjusted under 35 U.S.C. 154(b) by 0 days.

(21) Appl. No.: 09/239,660

(22) Filed: Jan. 29, 1999

(30) Foreign Application Priority Data

Jan. 30, 1998 (JP) ..... 10-019568
Aug. 21, 1998 (JP) ..... 10-235225

(51) Int. Cl.[7] ..... H01R 25/00
(52) U.S. Cl. ..... 439/638; 439/108
(58) Field of Search ..... 439/492, 499, 439/67, 177, 495, 496, 607, 108

(56) References Cited

U.S. PATENT DOCUMENTS

| | | | | |
|---|---|---|---|---|
| 3,082,398 | | 3/1963 | Valach | 439/492 |
| 3,189,864 | | 6/1965 | Angele et al. | 439/492 |
| 4,687,263 | * | 8/1987 | Cosmos | 439/108 |
| 4,747,787 | | 5/1988 | Siwinski | 439/108 |
| 5,116,239 | * | 5/1992 | Sinwinski | 439/497 |
| 5,509,827 | | 4/1996 | Huppenthal et al. | 439/627 |
| 5,556,300 | | 9/1996 | Parker | 439/497 |
| 5,738,545 | * | 4/1998 | Igarashi et al. | 439/607 |
| 6,066,000 | * | 5/2000 | Masumoto et al. | 439/607 |

FOREIGN PATENT DOCUMENTS

| | | |
|---|---|---|
| WO 86/06553 | 11/1986 | (EP) . |
| PCT/US86/00595 | 3/1986 | (WO) . |

* cited by examiner

*Primary Examiner*—Renee Luebke
*Assistant Examiner*—Briggitte R. Hammond
(74) *Attorney, Agent, or Firm*—Michael Best & Friedrich LLC; Laff, Whitesel & Saret, Ltd.; J. Warren Whitesel

(57) ABSTRACT

Plug and socket connectors, which are connected to each other along a first direction, constitute a high speed transmission connector, as for a notebook computer, for example. The connectors interconnect a printed circuit board (PCB) and a flexible printed circuit (FPC). The FPC fitting portion is a socket at the end of an insulator which is to be connected to the FPC. The PCB fitting portion comprises a plug connector which is to be connected to the socket connector and to a PCB connecting portion. The plug connector fitting portion has first and second socket contacts which come into contact with the plug side signal contact and the plug side ground contact, respectively, and enclose the socket connector fitting portion along a direction perpendicular to the first direction opposing each other along a direction perpendicular on the first direction.

19 Claims, 12 Drawing Sheets

PLUG CONNECTOR AND SOCKET CONNECTOR

BACKGROUND OF THE INVENTION

This invention relates to a two-piece electrical connector for connecting a flexible flat cable (FFC) or a flexible printed circuit (FPC) to a connection object such as a printed circuit board (PCB) and, in particular, to such a two-piece connector having metallic shells for electromagnetic shielding which is adaptive for high-speed transmission.

A two-piece electrical connector of the type described is used in, for example, notebook type computers. Such a two-piece electrical connector comprises a cable connector member mounted on a FPC or FFC (which will collectively be referred to as "FPC") and a mating connector member mounted on a PCB. The cable connector member is mated with the mating connector member to establish the connection between the FPC and the PCB.

In the prior art, the FPC generally comprises an insulator sheet or film having two laminated layers in which a plurality of signal conductors are embedded for transferring electric signals. A ground pattern is generally coated on at least one outer surface of the insulator film as an electromagnetic shielding in order to suppress the electro-magnetic interference generating noise.

JP-A-9 232039 discloses such a two-piece electrical connector which has metallic shells mounted on the outer surface thereof for protecting the connector from noise. A cable connector member in the known connector is provided with a cable fixture for fixing an end of the FPC to the cable connector member itself for establishing electrical and mechanical connection of the FPC and the cable connector member. The cable fixture is rotatably mounted on a connector housing of the cable connector member. That is, when the cable fixture is positioned at a first position or an open position, the one end of the FPC is loosely insertable in the cable connector member. When the cable fixture is angularly rotated to a second position or a fixing position, the one end of the FPC is pressed onto contact terminal portions in the cable connector member by the cable fixture so that the FPC is mechanically and electrically connected to the cable connector member. The cable connector has a metallic shell covering an outer surface of the connector housing and another metallic shell covering the cable fixture.

In the known connector, two pieces of different metallic shells are required for the cable connector member and another different metallic shell is required to a mating connector. Thus, metallic shells of three different shapes must be prepared and assembled to the two different connector members. This results in a high cost, complicate assembling operation, and difficulty of management and quality control of parts.

Further, in the known connector, the cable fixture is rotatably mounted on the connector housing. Therefore, the connector requires an increased mounting space in order to allow the rotation of the cable fixture. This results in difficulty of high density disposition of electric parts including the known connector.

In order to resolve the problems, a copending U.S. patent application Ser. No. 09/050,775 filed Mar. 30, 1998, now U.S. Pat. No. 6,066,000, proposes a two-piece electrical connector where fixing a FPC to a cable connector member is performed by a slider inserted together with one end portion of the FPC into a connector housing. A metallic shell fixedly supports the slider therein and is slidably fitted on the connector housing for providing the electromagnetic shielding. Insertion and removal of the slider for the connector housing are performed by a sliding operation of the metallic shell on the connector housing.

The connector proposed in the copending application described above will be referred to as a "prior connector", hereinafter.

However, both of the known connector and the prior connector still have various problems as described below.

The mating connector member mating with the cable connector member has a plurality of contacts of a pin type. There is a problem that the pin type contact is easy to bend when the cable connector member is connected thereto or removed therefrom.

Further, the cable connector member has contacts which have complicated structure. In particular, contacts of the prior connector has a complicated box-shaped structure for receiving the pin type contact. Therefore, it is difficult to establish the impedance matching. The impedance mismatching causes a problem for the high speed transmission.

Further, some of the contacts in cable connector member are arranged to come into contact with the ground pattern on the main surface of the FPC but has no electrical relation with the ground plate pattern on the back surface of the FPC. As a result, there is a disadvantage that grounding is incomplete.

Further, since ground ones of contacts of the mating connector member are not connected to the shell, ground condition is not maintained excellent if a ground signal flows through the ground contacts in the socket connector.

Still further, the cable connector member uses a rotating insulator or a slide insulator, and therefore, the number of the parts increases correspondingly. Further, since the height of the cable connector needs correspondingly an additional height for permitting rotation of the rotating insulator or the fitting of the slide insulator, there is such a disadvantage that the entire height is not reduced.

SUMMARY OF THE INVENTION

Accordingly, it is a first object of the present invention to provide a plug connector having only a small change of impedance due to a contact.

Further, it is a second object of the present invention to provide a plug connector capable of transmitting a ground signal securely and completely when the FPC is connected to a ground pattern.

Further, it is a third object of the present invention to provide a plug connector having a contact highly resistant to buckling deformation which may occur upon insertion or removal.

Still further, it is a fourth object of the present invention to provide a plug connector whose height can be reduced and in which the number of the parts can be minimized.

Still further, it is a fifth object of the present invention to provide a plug connector having a structure which is capable of insertion and ejection by sliding, and of locking tightly after the FPC has been connected to the plug connector, but which is easily removed or unlocked by the use of an ordinary jig or tool, such as a screw driver.

It is a sixth object of the invention to provide a socket connector highly resistant to buckling or deformation which may occur when the counter connector is inserted or removed.

It is a seventh object of the invention to provide a socket connector having an excellent ground condition and allowing an accurate and complete grounding.

It is an eighth object of the invention to provide a socket connector in which impedance matching is easy.

It is a ninth object of the invention to provide a socket connector in which the counter connector is easy to introduce, an end thereof making contact with the ground plate is difficult to buckle or deform, and a strength thereof is intensified so as to reduce a height of the product.

It is a tenth object of the invention to provide a socket connector coping with a high speed transmission and having a small size and excellent operability.

It is an eleventh object of the invention to provide a high speed transmission connector comprising a plug connector and a socket connector having the above described advantages.

According to one aspect of the present invention, there is provided a plug connector comprising a connector fitting portion to be connected to a counter connector along a first direction at one end of an insulator, and an FPC fitting portion to be connected to an FPC or FFC similarly along the first direction at the other end of the insulator. In the plug connector, the FPC fitting portion has a plurality of contact groups disposed within the insulator. Each of which consists of a pair of two first plug contacts arranged in a second direction intersecting the first direction and a second plug contact for transmitting a ground signal to between the pair.

According to another aspect of the present invention, there is provided a socket connector comprising a first counter connector fitting portion to be connected to a counter connector along a first direction and a substrate connecting portion to be soldered onto a substrate. The counter connector has a counter connector's signal contact and a counter connector's ground contact, provided in a second counter connector fitting portion thereof to be connected to the first counter connector fitting portion. The first counter connector fitting portion contains a first socket contact coming into contact with the counter connector's signal contact and a second socket contact coming into contact with the counter connector's ground contact. The first and the second socket contacts are disposed so as to enclose the second counter connector fitting portion in a direction perpendicular to the first direction such that they oppose each other along a direction perpendicular to the first direction.

According to still another aspect of the present invention, there is provides a high speed transmission connector comprising a plug connector and a socket connector to be connected to each other along a first direction. The plug connector comprises a socket connector fitting portion provided at an end of the insulator so as to be connected to the socket connector along the first direction and an FPC fitting portion provided at the other end of the insulator so as to be connected to FPC or FPC along the first direction. The socket connector comprises a plug connector fitting portion to be connected to the plug connector along the first direction and a substrate connecting portion to be soldered onto a substrate.

In the high speed transmission connector of the aspect of the present invention, the FPC fitting portion contains a plurality of contacts, each comprises a pair of first plug contacts arranged along a second direction perpendicular to the first direction and a second plug contact disposed between the pair for sending a ground signal. Both are disposed in the insulator. The plug connector contains a plug side signal contact and a plug side ground contact, both of which are provided at the socket connector fitting portion to be connected to the plug connector fitting portion. The plug connector fitting portion has a first socket contact coming into contact with the plug side signal contact and a second socket contact coming into contact with the plug side ground contact. The first and the second socket contacts are disposed so as to enclose the socket connector fitting portion along a direction perpendicular to the first direction such that they oppose each other along a direction perpendicular to the first direction.

DESCRIPTION OF THE PREFERRED EMBODIMENTS

Figure 1:
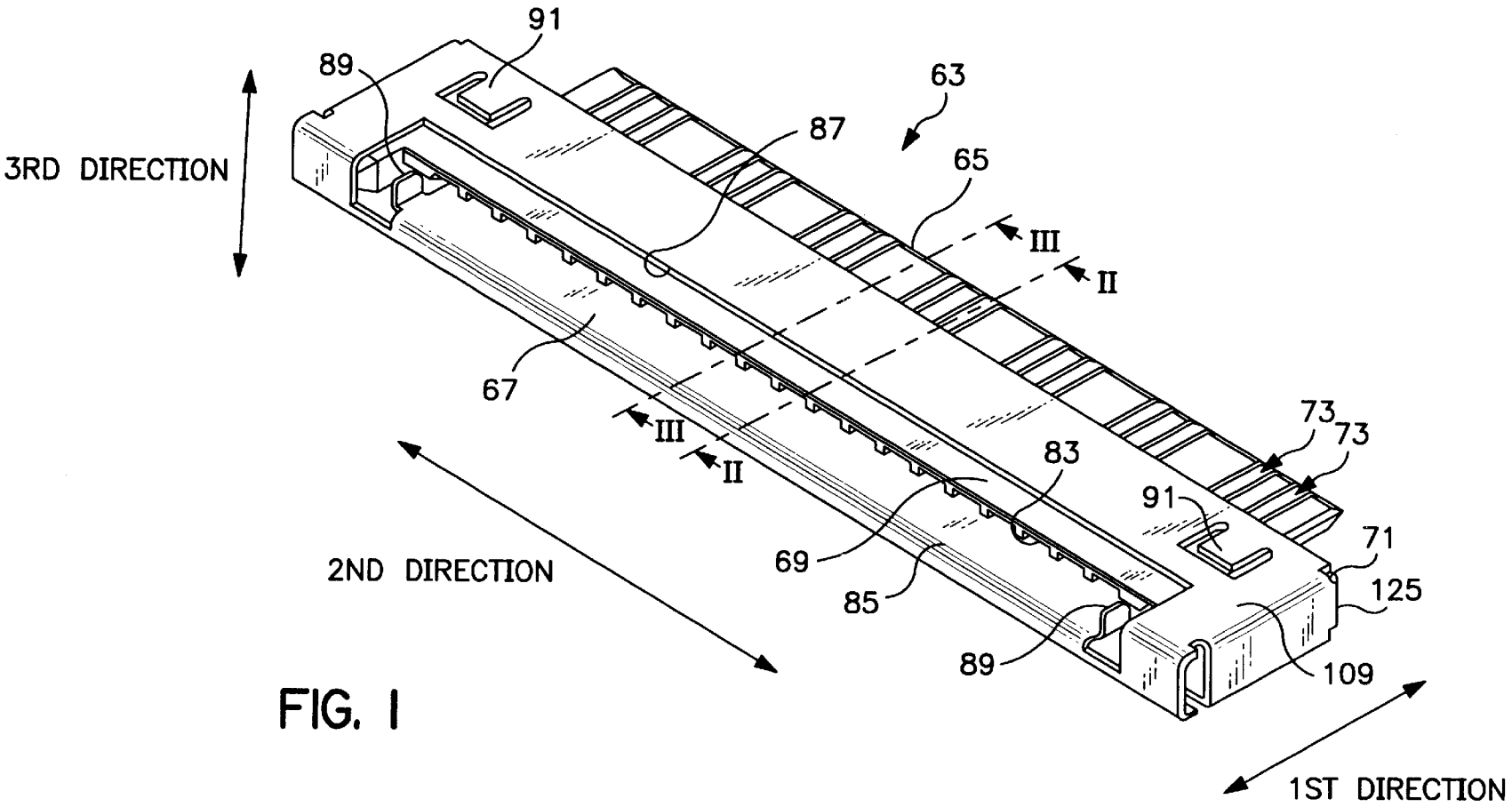
FIG. 1 is a perspective view showing a plug connector according to an embodiment of the present invention.

Referring to FIGS. 1 to 19, a description will be made as regards a two-pair connector according to an embodiment of the present invention. The two-pair connector comprises a cable connector member or a plug connector 63 (FIG.1) and a mating connector member of a socket connector 135 (FIG.14).

The plug connector 63 has a socket connector fitting portion 65 and an FPC fitting portion. The socket connector fitting portion 65 is to be connected to a socket connector serving as a substrate side connector (not shown) along a first direction which is a fitting direction. The FPC fitting portion 67 is to be fit to the FPC or FFC along the same first direction. Both of the fitting portions are provided on both ends in the fitting direction which is the first direction. Here, for convenience for description, two opposite sides of the plug connector 63, that is a side of the FPC fitting portion 67 and another side of the socket connector fitting portion 65 , will be called "front side" and "rear side", respectively, relative to the first direction.

The plug connector comprises an insulator 69, a shall 71, a plurality of contacts 73, and a ground plate 75. The insulator 69 is made of insulating material. The shell is provided for covering the insulator 69. The plurality of contacts are arranged in the width direction which will be referred to as a second direction perpendicular to the first direction and inserted in the insulator 69. This plug connector will be hereinafter referred to as "first plug contact". The ground plate 75 is inserted into insulator 69 in a manner so that it will not have contact with any of the first plug contacts. Such a first plug contact 73 is formed by a leaf spring so that any change of its impedance is relatively small.

The insulator 69 has a horizontal substantially Y-shaped section produced by overlapping ends of an upper plate 77, (FIG.2) a middle plate 79 and a lower plate 81 in a third direction perpendicular to the first and the second directions, that is, in the thickness direction, such that the respective plates are staggered from each other horizontally. A bottom end of the upper plate 77 has protrusions extending in the first direction and forming an accommodating groove 83 for accommodating a contact which is one end side of the FPC.

The shell 71 is in the form of a box made of conductive material having an opening at its rear end. At the front end, an opening is formed which has a slider portion 85 composed of a flat plate folded backward. A front end portion of the insulator 69 is projected into the opening 87. An FPC fitting portion 67 into which the FPC is to be inserted is formed by the slider portion 85 and a front end portion of the upper plate 77 of the insulator 69.

Further, on both sides of the slider portion 85, stopper pieces 89 are provided as stopping means which prevents the FPC (not shown) from slipping out as well as guiding an insertion of the FPC. Further, on both sides of the top surface of the shell 71, spring pieces 91 are provided which are formed by incision.

Figure 2:
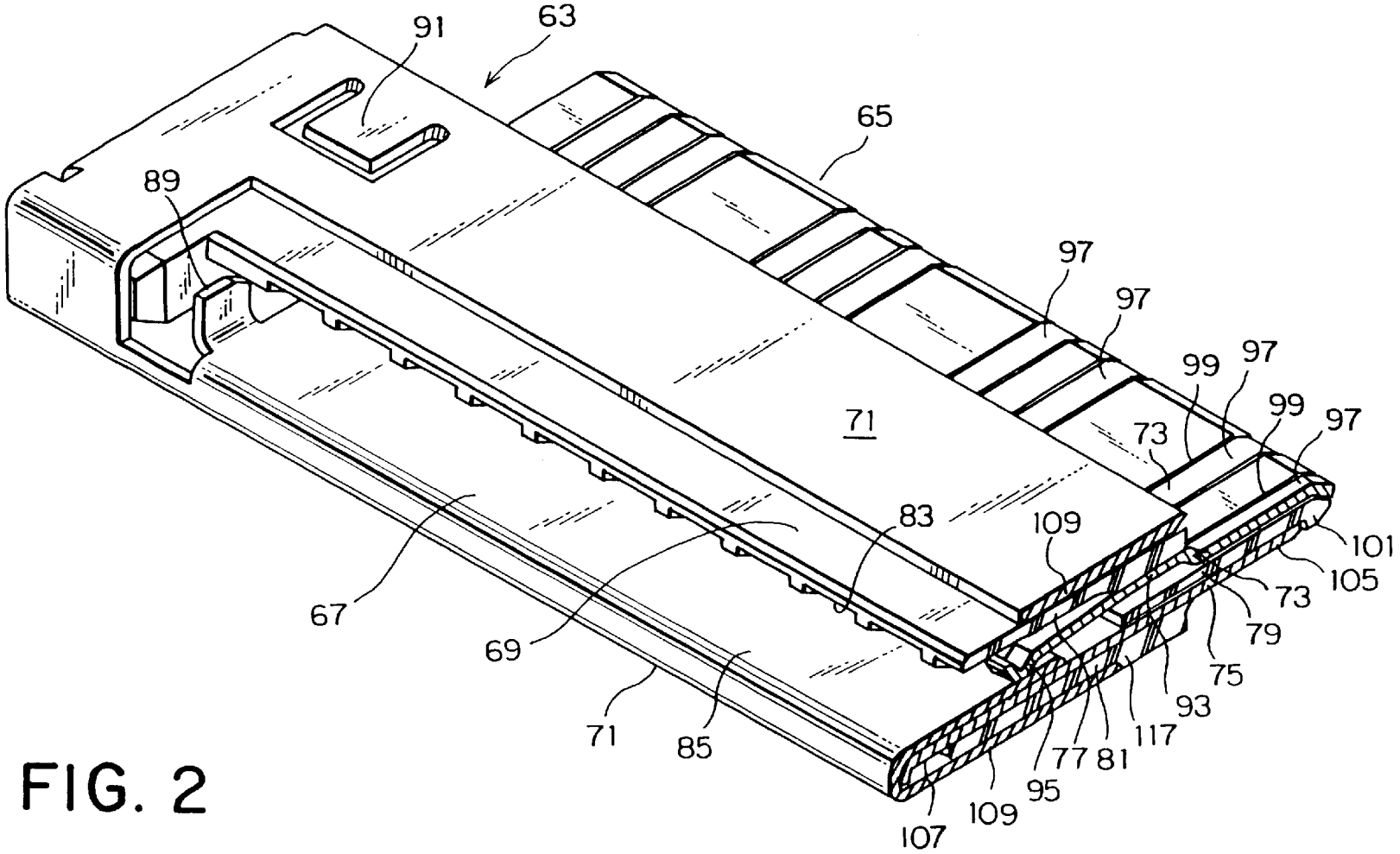
FIG. 2 is a perspective view having a partial sectional view taken along the line II—II of the plug connector of FIG. 1.

As best shown in FIG. 2, each of the first plug contacts 73 has a single sheet simple leaf spring structure having only a small change of impedance. The first plug contact comprises a pressed portion 93, an FPC contact portion 95, and a contact contacting portion 97. The pressed portion 93 is pressed and supported by the insulator 69. The FPC contact portion 95 extends forward from the pressed portion 93 so as to project into the FPC fitting portion 67, whose end is curved in the form of U shape. The contact contacting portion 97 extends backward from the pressed portion 93 along a surface of the insulator 69, and is bent downward along a rear end slope of the insulator 69.

A plurality of first plug contacts 73 is spaced in the width direction. Particularly being conscious of the operation signal, two pieces of the first plug contact 73 are paired and in this example, seven pairs are provided.

The contact contacting portion 97 is inserted in a groove 99 provided on the top surface of the middle plate 79 of the rear end of the insulator 69. In the connector fitting portion 65 to be connected to the socket connector, on the back surface of the contact 73 there is placed a ground plate 75 nipping the insulator 69.

The contact contacting portion 97 and the ground plate 75 are provided as they nip this insulator 69 and are in the form of a single plate, so that a non-pin connector fitting portion 65 having no pin is formed at the rear end of the plug connector 63.

Figure 3:
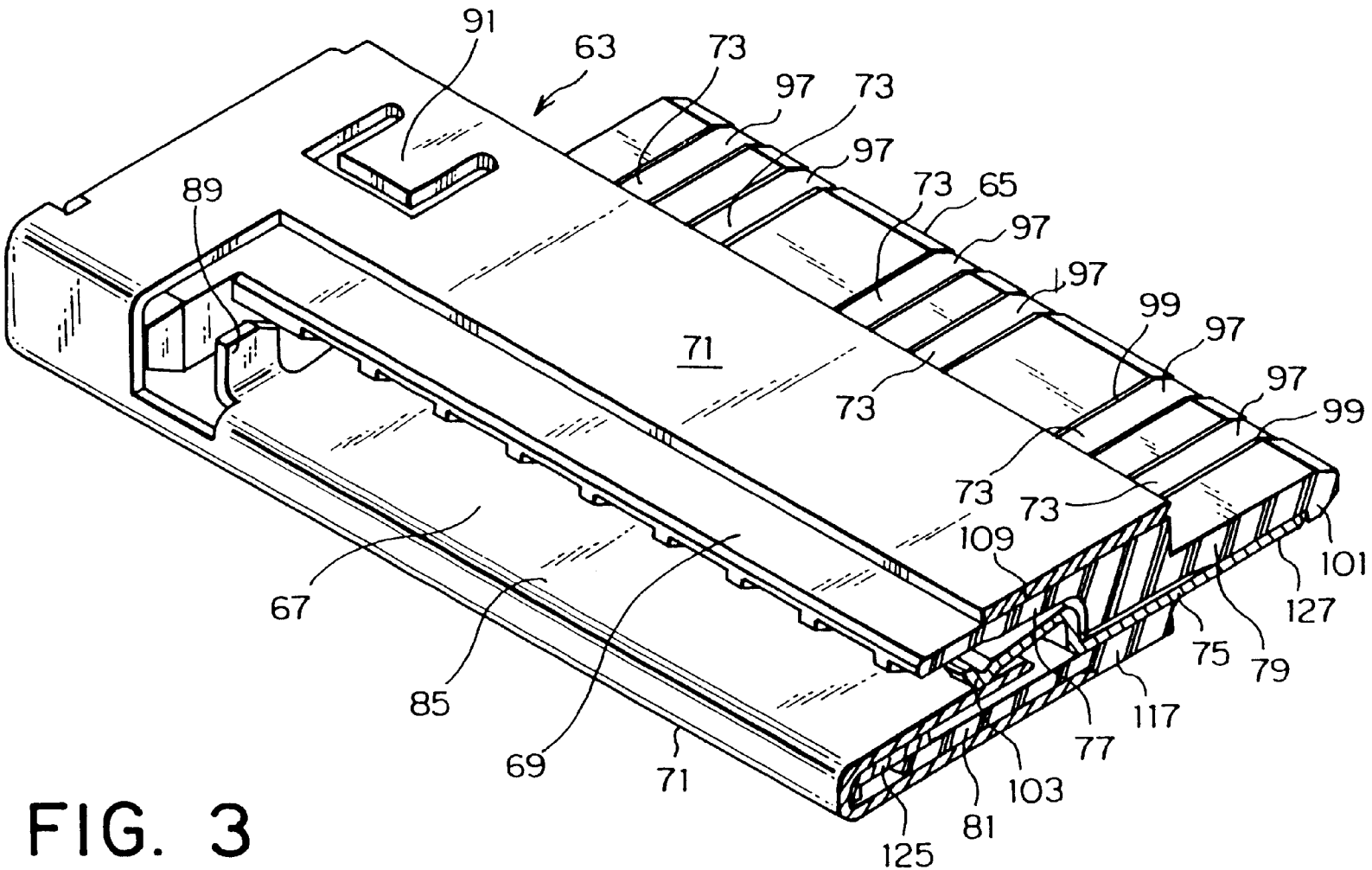
FIG. 3 is a perspective view having a partial sectional view taken along the line III—III of the plug connector of FIG. 1.

As best shown in FIG. 3, the front side of the ground plate 75 is disposed such that it is nipped between the slider portion-85 and insulator 69 and the rear portion thereof is exposed on the bottom surface of the rear end of the insulator 69, so that it extends up to protrusion 101 projecting downward of the middle plate 79 of the insulator 69. Further, as to the ground plate 75, its cut piece formed by incision is erected from a plate surface thereof and bent forward and its front end is bent in the form of U shape like the FPC contacting portion (FIG.2) so as to form a contact type spring contacting portion 103 (hereafter referred to as "second plug contact") projecting into the FPC fitting portion 69. This second plug contact 103 of the ground plate 75 is provided so as to make contact with the ground pattern of the front side pattern of the FPC and disposed between the FPC contacting portions 95 of the first plug contacts 73 of each pair.

Figure 4:
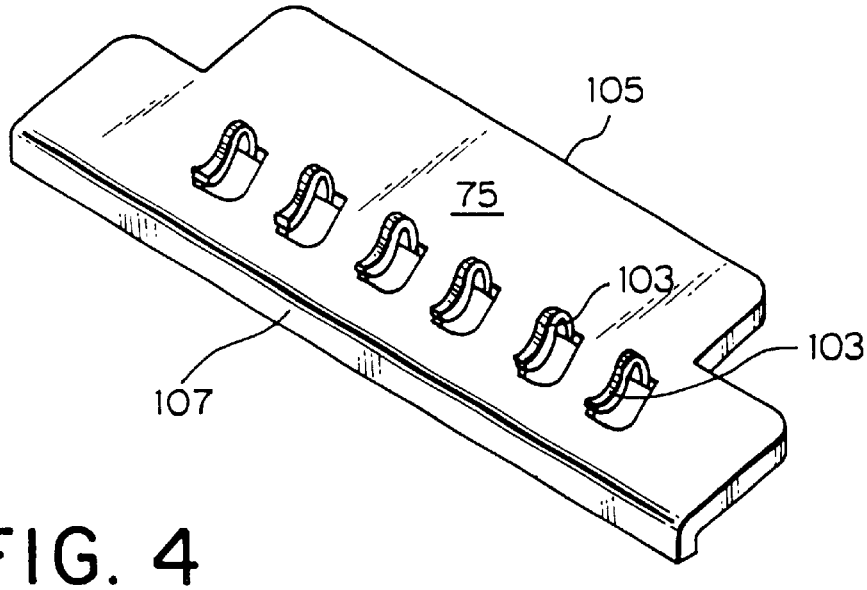
FIG. 4 is a perspective view showing only a ground plate shown in FIGS. 1 to 3.

As shown in FIG. 4, the spring contacting portions (second plug contact) 103 to be connected to the ground pattern of the front side pattern of the FPC are disposed at several positions. This spring contacting portion 103 is disposed between the first plug contacts 73 of each pair as described previously and the spring contacting portion consisting of the second plug contact 103 is so constructed as to nip the fitting FPC so that it makes contact with the ground patterns of the front and back sides of the FPC, thereby securely transmitting the ground signal of the FPC Further, since the socket connector fitting portion 105 to be connected to the socket connector (not shown) is of a single sheet, it is capable of transmitting the ground signal through a wide area. Additionally, an opposite side of the socket connector fitting portion 105 side becomes a front piece suspending vertically.

Figure 5:
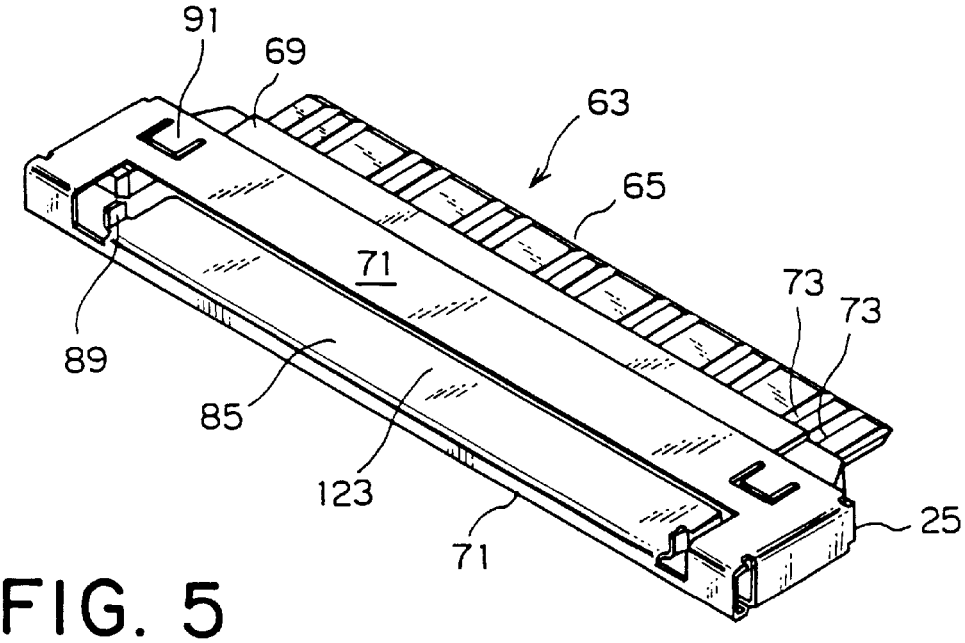
FIG. 5 is a perspective view showing a state in which the slider portion of the plug connector shown in FIGS. 1 to 4 is released.
Figure 6:
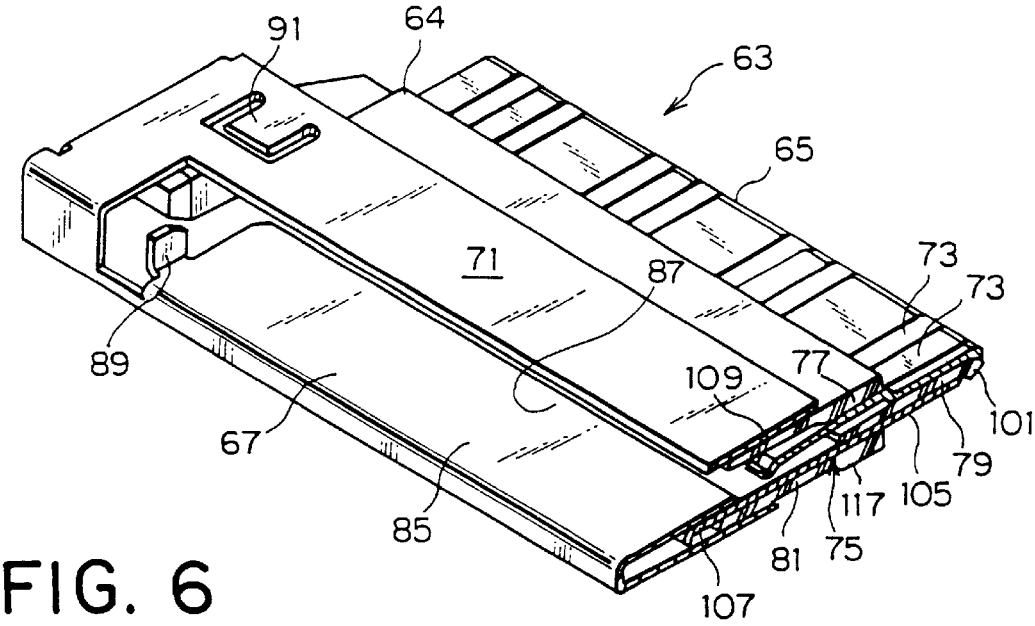
FIG. 6 is a perspective view having a partial sectional view taken at the same position as FIG. 2 of the plug connector of FIG. 5.
Figure 7:
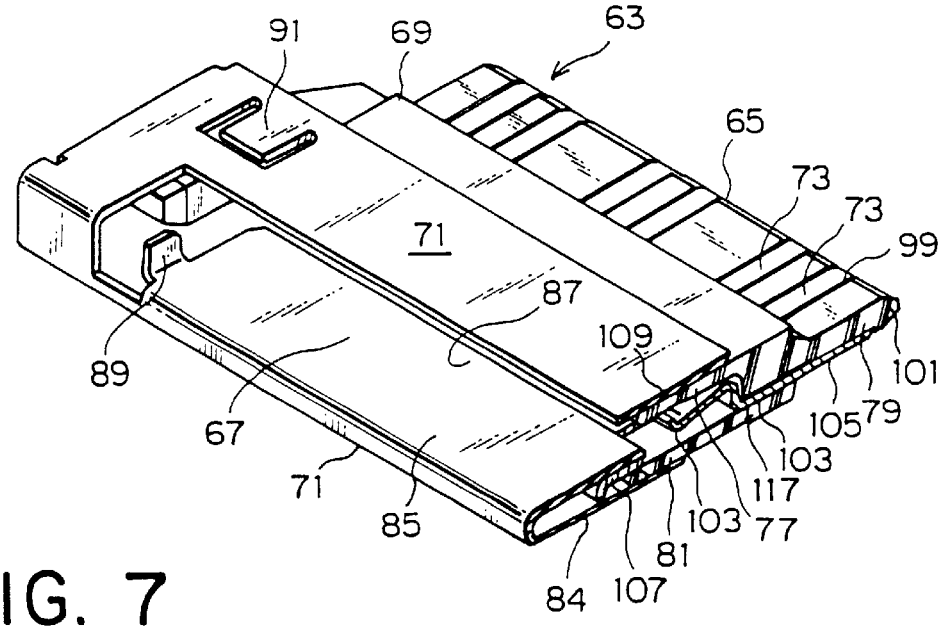
FIG. 7 is a perspective view having a partial sectional view taken at the same position as FIG. 3 of the plug connector of FIG. 5.

As shown in FIGS. 5 to 7, under a released state of the plug connector, by sliding the shell 71 forward relative to the insulator 69 on which the first plug contact 73 and ground plate 75 are mounted, the plug connector 63 reaches the released state.

Figure 8:
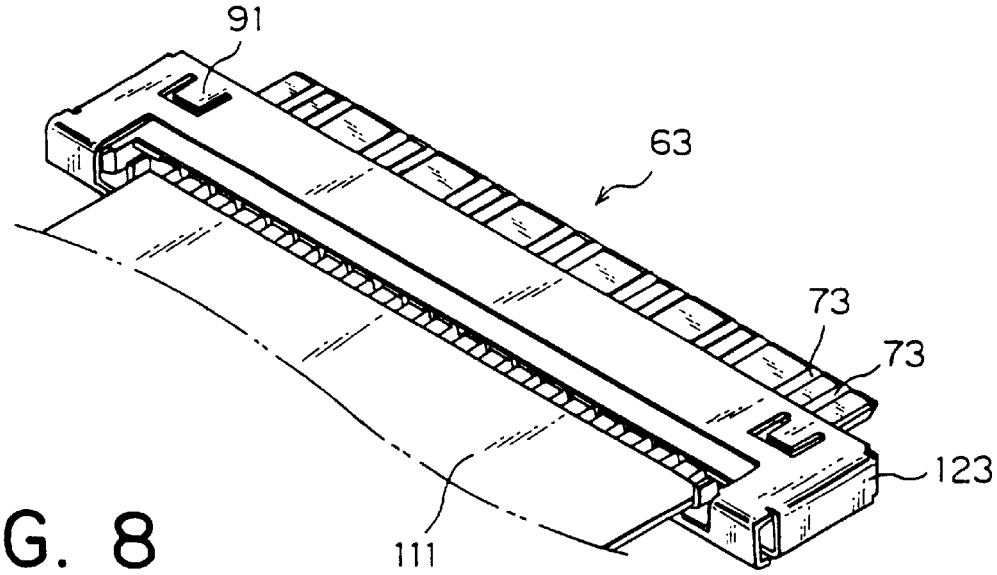
FIG. 8 is a perspective view showing a connected state between the plug connector shown in FIGS. 1 to 7 and a FPC.
Figure 9:
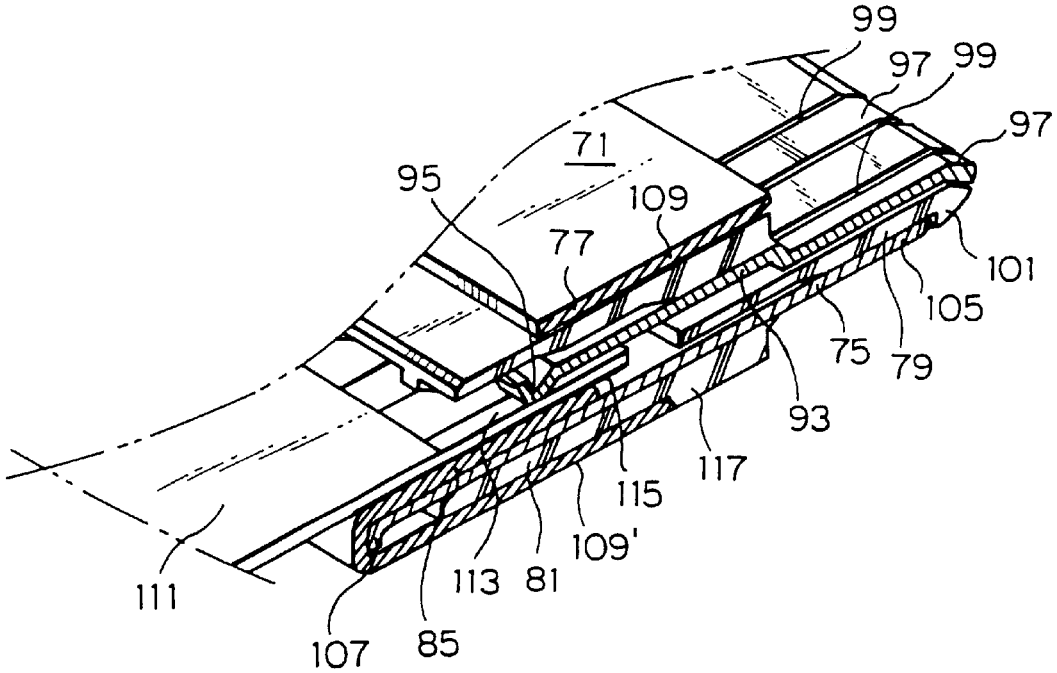
FIG. 9 is a perspective view having a partial sectional view taken at the same position as FIG. 2 of the plug connector shown in FIG. 8.
Figure 10:
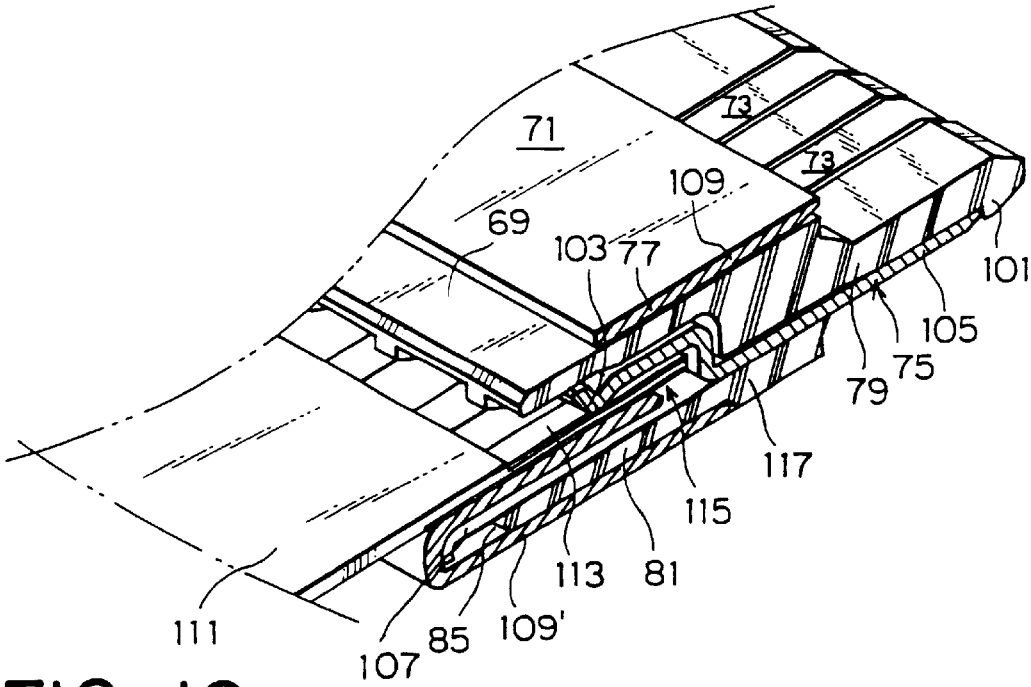
FIG. 10 is a perspective view having a partial sectional view taken at the same position as FIG. 3 of the plug connector shown in FIG. 8.

Referring to FIGS. 8 to 10, in the released state shown in FIG. 6, the FPC 111 is inserted and next the shell 71 is pushed to the insulator 69 side. A front end of a bottom portion 109 of the shell 71 comes into contact with a projecting step portion 117 on the bottom of the insulator 69, so that the motion of the shell 71 is blocked, thereby completing the fitting.

At this time, as best shown in FIG. 9, the surface pattern 113 of the FPC 111 comes into contact with the FPC contacting portion 95 of the first plug contact 73. On the other hand, the back surface ground pattern 115 of the FPC 111 comes into contact with the slider portion 85 of the shell 71, so that it is electrically connected to the ground plate 75 through an end portion 107 of the ground plate 75 in contact with an inner lower surface of the shell 71.

Further, as best shown in FIG. 10, when the slider portion 85 of the shell 71 penetrates under the FPC 111, the FPC 111 is pushed upwardly, so that the spring contacting portion 103 of the ground plate 85 comes into contact with the surface pattern 113 of the FPC 111. Further in a similar manner, previously the back surface pattern 115 of the FPC 111 comes into contact with the slider portion 85 of the shell 71, so that it is electrically connected to the ground plate 75. When the FPC is connected to the shell 71, the slider portion 85 makes electrical contact with the back surface ground pattern 115 of the back side of the FPC 111, so that the ground signal of the FPC 111 can be transmitted securely.

Figure 11:
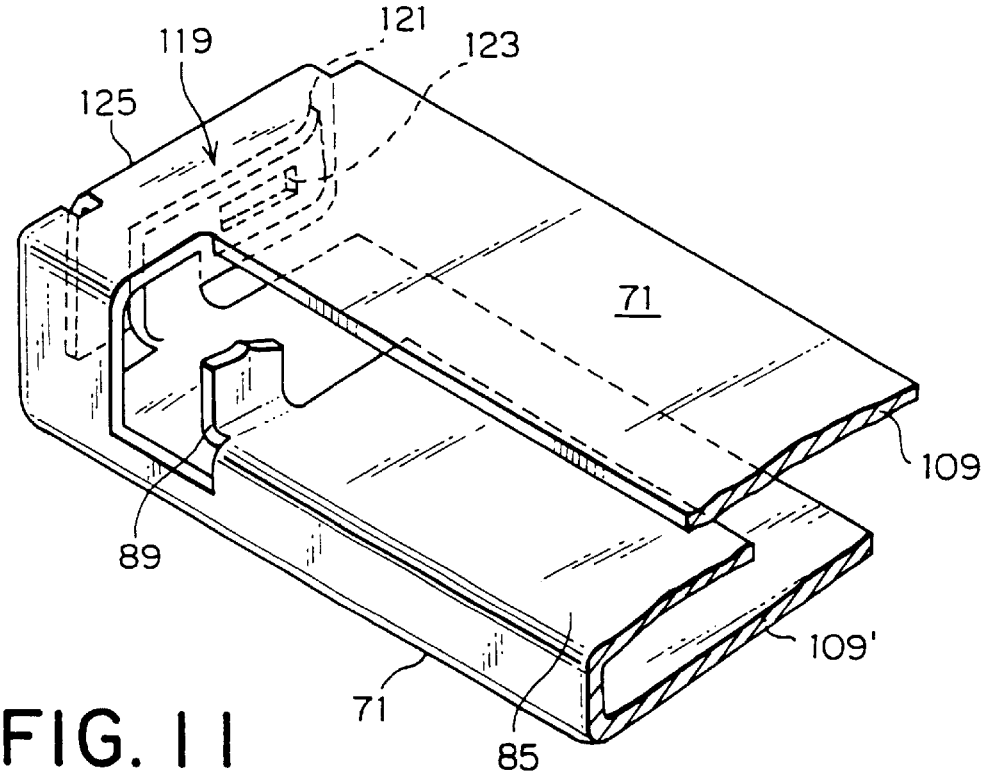
FIG. 11 is a partial perspective view showing mainly a locking portion for an insulator, provided in a shell of the plug connector according to an embodiment of the present invention.

As shown in FIGS. 10 and 11, a locking portion 119 is formed on the shell and serves as a locking means. The locking portion 119 contains a spring portion 121, a rectangular portion 123, and a spring deflection stopper portion. The spring portion 121 is formed near the side portion of the shell 71. The rectangular hole portion 123 is formed in the spring portion 121. The spring deflection stopper portion 125 is formed outside the spring portion 121 of the shell 71. Furthermore, the locking portion 119 is provided with a protrusion 127 (FIG.2) on the side surface of the insulator 69.

Figure 12:
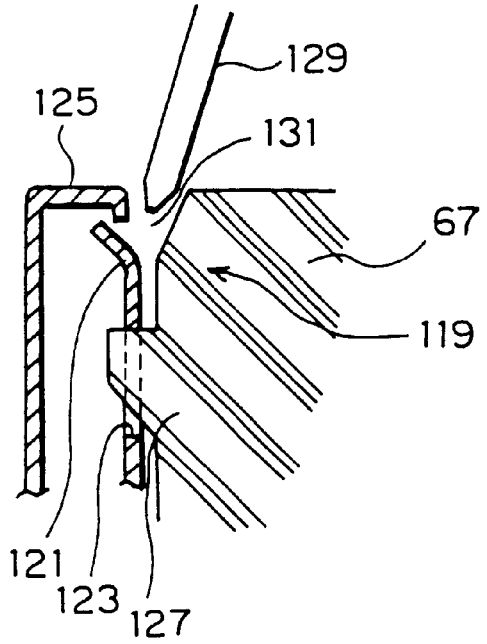
FIG. 12 is a partial plan sectional view showing mainly a locking portion for an insulator, provided in a shell of the plug connector according to the embodiment of the present invention.

As best shown in FIG. 12, by inserting the protrusion portion 127 of the insulator 69 into the hole portion 123 of the spring portion 121 when the FPC is connected, the shell 71 and insulator 69 are prevented from moving, that is, locked. If they are once locked, even if the FPC 111 is pulled relative to the insulator 69, it cannot be loosened.

However, as shown in FIG. 12, by inserting a jig 129 such as a screwdriver into a gap 131 formed at the rear on both sides of the plug connector 63 and moving the spring portion 121 downwardly and outside, the engagement between the hole portion 123 of the spring portion 121 and the protrusion 127 of the insulator 69 is released, so that the shell 71 can slide, thereby making it possible to release the FPC 111 easily.

Figure 13:
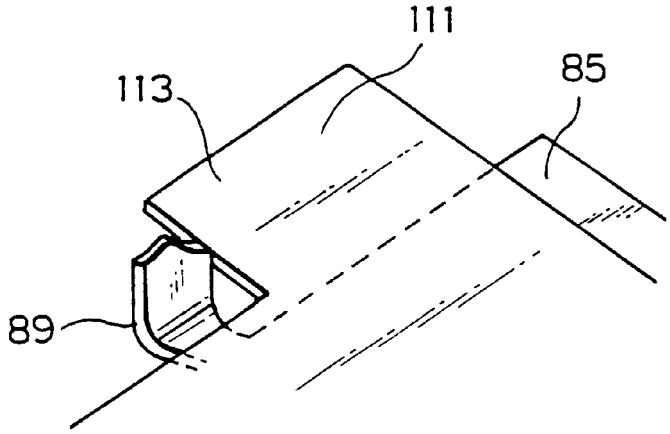
FIG. 13 is a perspective view showing a loosening stopper mechanism provided on a shell as a loosening stopper means of the plug connector according to the embodiment of the present invention.
Figure 14:
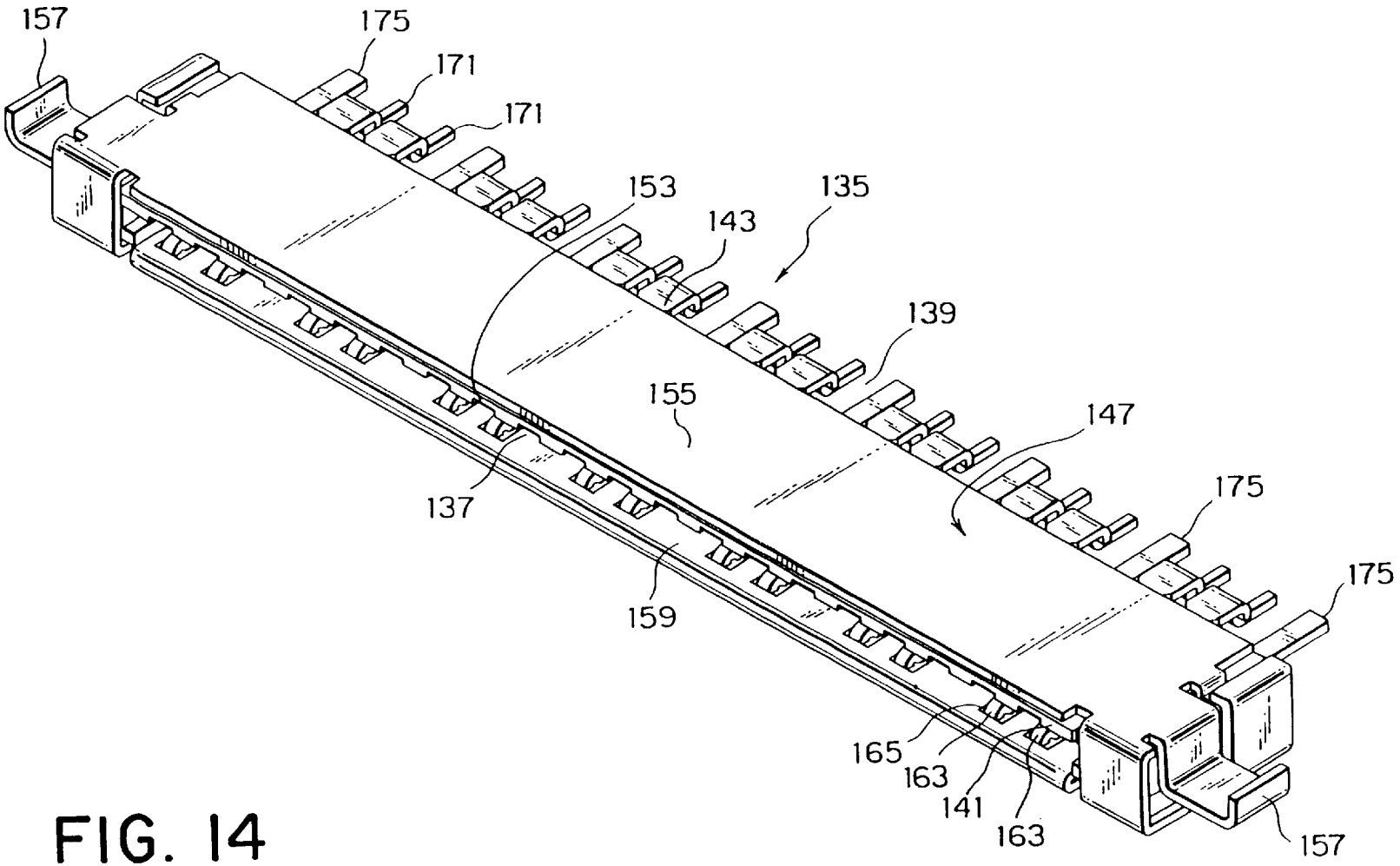
FIG. 14 is a perspective view of a socket connector according to the embodiment of the present invention.

Further, as shown in FIG. 13, a loosening stopper mechanism is constructed, in which loosening stopper portions 133 projecting in the width direction are formed on the front end at both sides of the FPC 111. The stopper pieces 89 is formed on both sides of the shell 71. When the FPC is connected, the stopper pieces 89 come into contact with the loosening stopper portions 133, thereby preventing the FPC 111 from being loose.

In the above, although the plug connector of an embodiment of the present invention has been described only with respect to the FPC fitting portion to be connected to the FPC 111, it is apparent that this FPC fitting portion can be similarly used also for the FFC.

As described above, according to the present invention, since the contact is formed of a single leaf spring, it is possible to provide a plug connector in which a change of impedance is small.

Further, according to the present invention, since a single ground plate is in contact with the ground pattern on one surface of the FPC. On the other surface of the FPC, it is possible to provide a plug connector capable of transmitting the ground signal securely and completely.

Furthermore, according to the present invention, since the connector fitting portion to be connected to the socket connector has a non-pin structure, it is possible to provide a plug connector highly resistant to buckling which may occur upon fitting or removal.

Still further, according to the present invention, since the second plug contact of the ground plate which is to be in contact with the front side ground pattern of the FPC is so structured as to nip the FPC by itself, it is possible to provide a plug connector having a high contact reliability.

In addition, according to the present invention, since the shell has a function of the slider portion to achieve ZIF type fitting and this function is carried out without any other help, the thickness of the product can be reduced and it is possible to provide a plug connector whose number of parts can be minimized.

Further, according to the present invention, since the shell having a function as the slider portion has every locking function, after the FPC is connected, it cannot be loosened easily and, in addition, by using a jig such as a screwdriver, it is easy to operate the slider to remove the FPC.

Next, the socket connector of the embodiment of the present invention will be described with reference to FIGS. 14–19.

Figure 15:
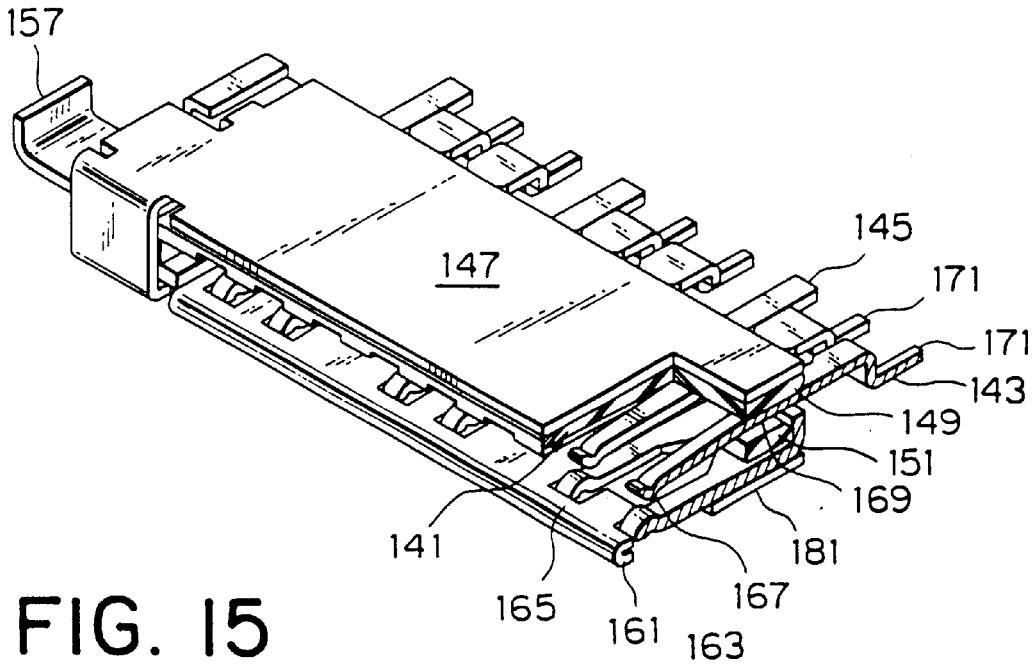
FIG. 15 is a partially broken, partial sectional view of the socket connector of FIG. 14.

Referring to FIGS. 14 and 15, a socket connector 135 has a plug connector fitting portion 137 which is connected to the aforementioned plug connector 21 along a first direction, provided at a front end thereof and a substrate connecting portion 139 to be soldered to a substrate, provided at a rear end thereof. For convenience of description, along the first direction, a side of the plug connector fitting portion 137 of the socket connector 135 is called front side and a side of the substrate connecting portion 139 to be connected to a substrate is called rear side.

The socket connector 135 comprises an insulator 141 having an L-shaped section, a signal socket contact 143 (hereinafter referred to as first socket contact) implanted in the insulator 141, a ground plate or ground contact 145, and a shell 147 provided around the insulator for serving as a shield ceiling of the socket.

The insulator 141 has a top plate 149 and a bottom plate 151 provided at a rear end of the socket connector 135 integrally with the top plate 149. The first socket contact 143 is implanted between the top plate 149 and bottom plate 151.

The shell 147 is a box type and has an opening 153 at a front end thereof, and comprises a top plate 155 covering the insulator 141, substrate fixing portions 157 provided at both ends in the width direction of a second direction perpendicular to the first direction so as to protrude in a U-shape, and a bottom plate 159. The substrate fixing portion 157 acts as a soldering portion for a PCB and the shell 147 has an electrical function for grounding.

In the shell 147, the bottom plate 159 has a folding portion 161 in which a front end thereof is folded so as to form double layers, a cutout portion 165 cut out corresponding to a contact portion 163 of the ground contact 145 which will be described in detail later and a lower bottom portion 181. The folding portion 161 introduces a socket connector fitting portion of the plug connector which is a counter connector of the socket connector 135 and intensifies the strength. The cutout portion 165 of the shell 147 protects a front end of the contact portion 163 of the ground plate 145 which will be described later.

As evident in FIG. 15, the first socket contact 143 which is a signal contact has a resilient spring property and a narrow sheet-like configuration corresponding to the impedance matching. The first socket contact 143 comprises a contact portion 167 one end of which is accommodated in the plug connector fitting portion and bent in a V-shape so as to make contact with the counter contact, a supporting portion 169 extending from the contact portion 167 backward of the connector and fixed to the insulator 141 such that it is supported thereby, and a soldering terminal portion 171 which extends from the supporting portion 169 backward of the socket connector 135 along the first direction and is bent to extend along a third direction perpendicular to the first and second directions and further is bent in the first direction which is a horizontal direction so as to extend horizontally, providing a means for soldering on a PCB. As described above, the signal contact 143 has a simple sheet-like structure, thereby making it possible to achieve impedance matching.

Figure 16:
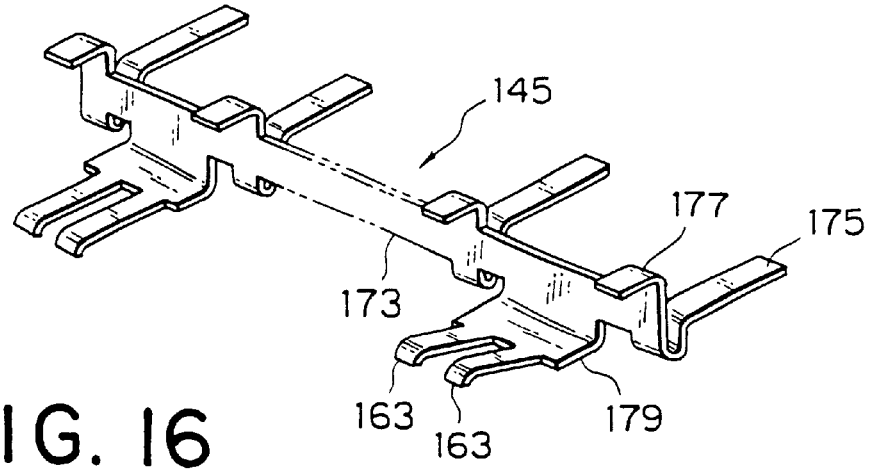
FIG. 16 is a perspective view showing a ground plate of FIGS. 14 and 15.

Referring to FIG. 16, the ground plate 145 is formed by punching and pressing a single conductive material plate, constituted of a link portion 173 extending along the second direction which is a width direction of the socket connector 135, soldering terminal portions 175 bent from the link portion 173 and extending backward, fixing portions 177 which extend upward from the same position as the soldering terminal portion 175 and is bent forward providing a means for connecting to the insulator, contact base portions 179 disposed between the soldering terminal portion 175 and fixing portion 177 and having a resilient spring property, and pairs of the contact portions 163 (second plug contact) extending from each of the contact base portions 179 in parallel.

Referring to FIGS. 14 and 15, a pair of the first socket contacts 143 which are signal contacts are disposed in parallel, so that concretely, seven pairs thereof are supported by the insulator 141. That is, the first socket contacts 143 of the socket connector 135 transmit seven pairs of differential signal.

In the plug connector fitting portion 137 of the socket connector 135, the contact portion 167 of the first socket contact 143 is provided on a side of the top plate and the second socket contact 163 formed of the contact portion of the ground plate 145 is provided on the bottom side opposing the contact portion 167 of the first socket contact 143 in the third direction. The second socket contact 163 is accommodated in the cutout portion 165 of the shell 147. When the plug connector is connected, the fitting portion of the plug connector is nipped by the contact portion 167 of the first socket contact 143 and the second socket contact 163 from up and down.

The soldering terminal portions 175 of the ground plate 145 are disposed so as to enclose the soldering terminal portions 171, 171 of the first socket contact 143 for signaling protruded backward of the socket connector 135 along the second direction (width direction of the socket connector 135). By protruding the soldering terminal portion 175 from the ground plate 145 as much as possible, the grounding condition can be improved.

Figure 17:
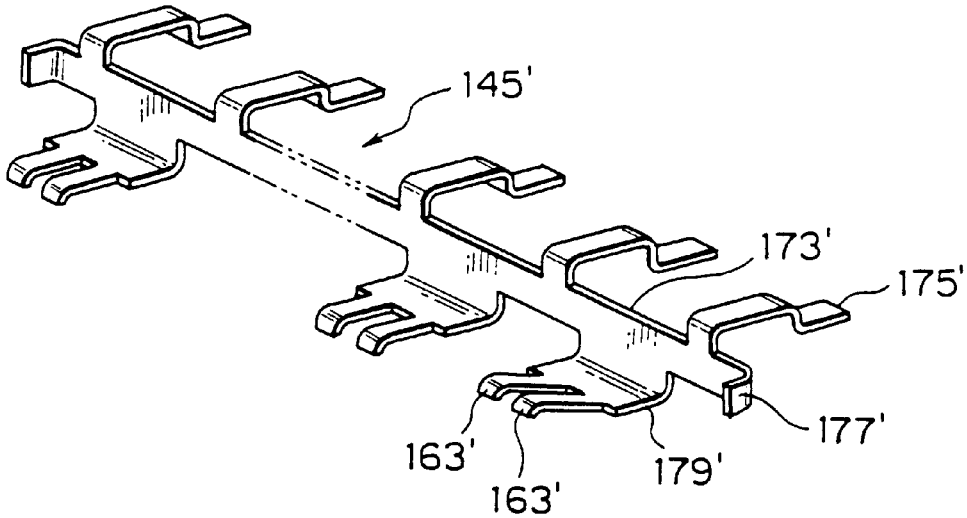
FIG. 17 is a perspective view showing a modification of the ground plate of FIG. 16.

Referring to FIG. 17, in a ground plate 145' according to a modification, fixing portions 177' are formed on both ends of a link portion 173', soldering terminal portions 175' extend from the top of the link portion 173' and like the ground plate shown in FIG. 16, contact base portions 179' extend from a bottom of the link portion 173' and further, contact portions 163', 163' are formed so as to be continuous with the contact base portion 179'.

Figure 18:
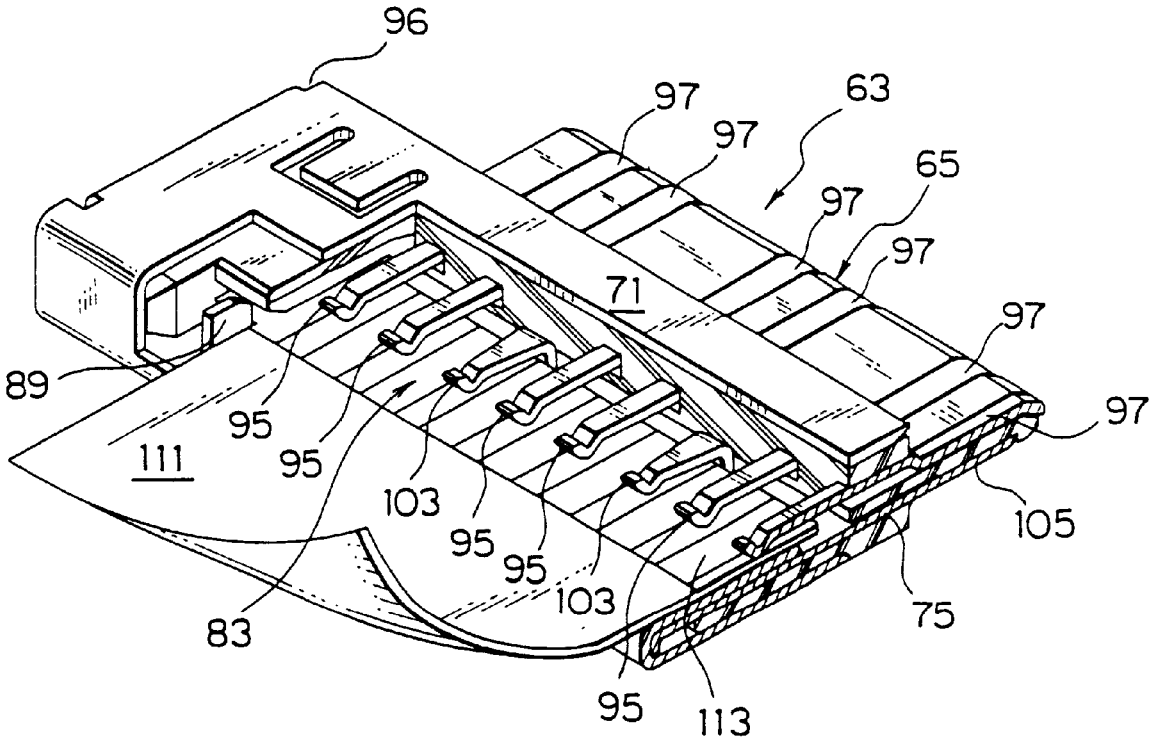
FIG. 18 is a diagram showing an example of a section of the counter plug connector shown in FIG. 1.

As shown in FIG. 18, the plug connector 63 has a FPC fitting portion 83 at one end thereof and a socket connector fitting portion 65 at the other end thereof. Reference numeral 111 denotes FPC connected and locked to the FPC fitting portion.

Next, connecting between the socket connector and plug connector according to the embodiment of the present invention will be described with reference to FIG. 19.

Figure 19:
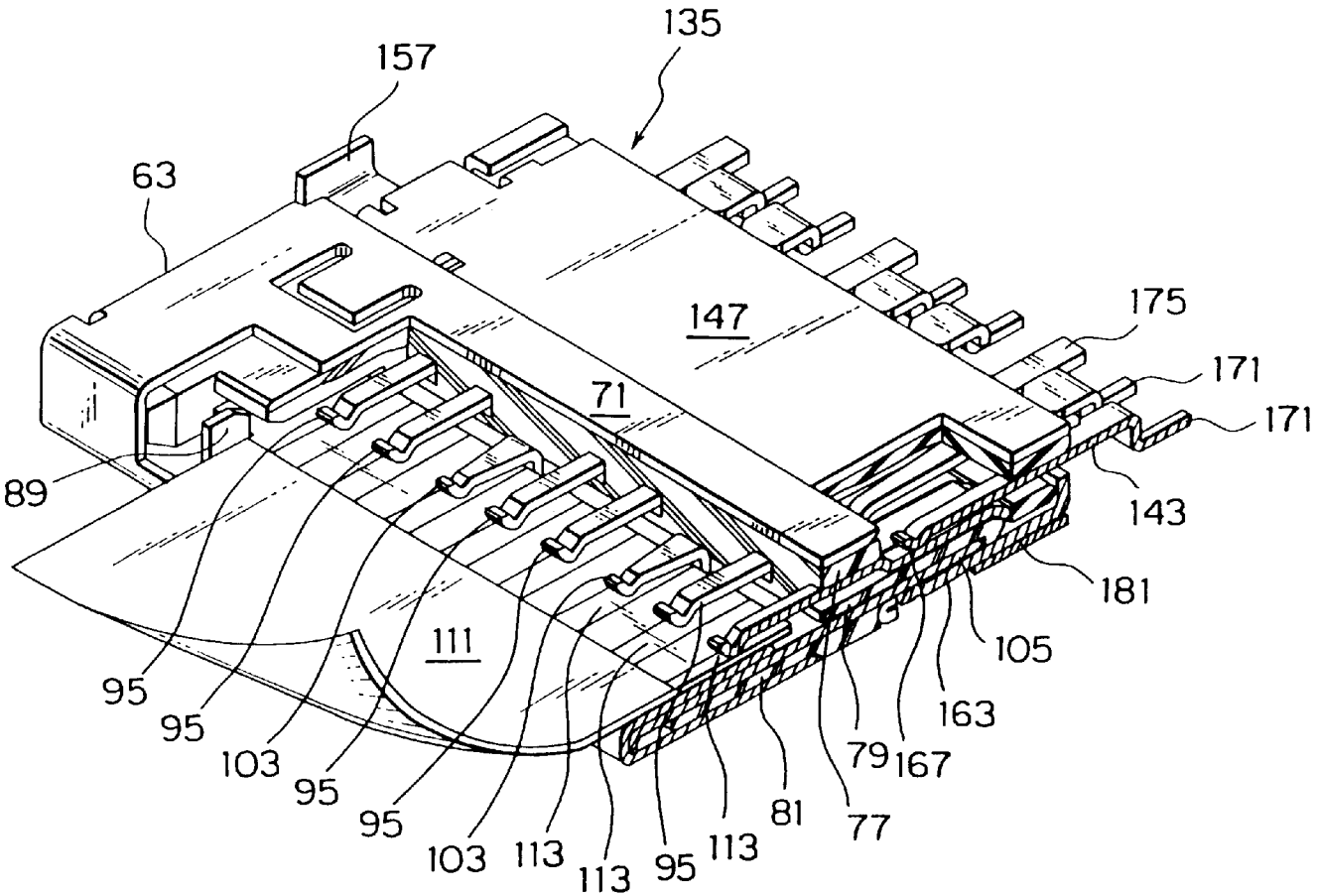
FIG. 19 is a partial sectional view showing a condition in which the plug connector shown in FIG. 1 or 18 is connected to the socket connector shown in FIG. 14.

As shown in FIG. 19, in the plug connector fitting portion, the contact portion 167 of the first socket contact 143 forming a pair with the other one, which is a signal contact of the socket connector 135 and the second socket contact 163 which is a contact portion of the ground plate 145 of the socket connector 135 are disposed along the third direction so as to oppose each other.

When the socket connector fitting portion of the plug connector 63 and the plug connector fitting portion of the socket connector 135 are connected to each other, the plug connector 63 is nipped between the contact portion 167 of the first socket contact 143 and second contact portion 163 disposed along the third direction so as to oppose each other in the plug connector fitting portion.

At this time, the contact portion 95 of the first plug contact which is a signal contact of the plug connector 63 comes into contact with the contact portion 167 of the first socket contact which is a signal contact of the socket connector 135.

On the other hand, the ground contact portion 105 of the ground plate 75 of the plug connector 63 comes into contact with the contact portion 163 of the ground plate 145 of the socket connector 135. Further, a back side of the contact proximal end of the ground plate 145 of the socket connector 135 comes into contact with the lower bottom portion 181 of the shell 147.

As described, in the socket connector 135 according to the embodiment of the present invention, the contact portion 35*c* of the signal contact 143 and contact portion 163 of the ground plate 145 are located up and down in the plug connector fitting portion, thereby forming a non-pin type socket connector which is highly resistant to buckling or deformation which may occur when the plug connector 63 is inserted or removed.

Further, the ground plate 145 has a plurality of the contact portions as a ground fitting contact portion and the plurality of the soldering terminal portions 175 (FIG.16) are formed on a single plate as a single part, ground condition is excellent and grounding is accurate and complete. Further, the contact portions 163 of the ground plate 145 are in contact with the shell 147 through plural points, excellent ground condition can be further maintained.

Because the signal contact 143 of the socket connector 135 according to the embodiment of the present invention is of a simple sheet-like configuration, impedance matching is easy. Because the bottom portion of the side to which the plug connector 63 is to be connected to the shell 147 has the folding portion 161, (FIG.15) it can introduce the counter connector easily. Further because the cutout portion 165 is provided on the bottom, it is possible to prevent the contacting end of the plug connector from being buckled or deformed by the ground plate 145. Further, the folding portion 161 of the shell 147 intensifies the strength and eliminates the necessity of the insulator 141 at this portion, thereby making it possible to reduce the height of this product.

Because according to this invention, there is provided a non-pin type socket connector in which the signal contact and ground plate fitting contact portion are located up and down, a socket connector highly resistant to buckling or deformation which may occur when the counter connector is inserted or removed can be provided.

Further, because according to this invention, the ground plate has a plurality of contact portions to achieve ground fitting contact and a plurality of the soldering terminals as a single plate (as a single part), ground condition is excellent and grounding is accurate and complete. Further, because the spring portion of the ground contact portion comes into contact with the shell through plural points, it is possible to provide a socket connector having an excellent ground condition.

Further, because, according to this invention, the signal contact is of a simple sheet-like structure, it is possible to provide a socket connector in which impedance matching is made easy.

Further, because according to this invention, the folding portion is provided at a portion to be connected to the counter plug connector of the shell, the counter connector can be introduced easily and additionally, the cutout portion makes it difficult for the contacting end portion to be buckled or deformed by the ground plate. The folding portion intensifies the strength of the socket connector and eliminates the necessity of the insulator at this position thereof, thereby reducing the height of the product.

Therefore, according to this invention, it is possible to provide a socket connector capable of meeting high speed transmission and having a small size and an excellent operability.

Further, according to this invention, it is possible to provide a high speed transmission connector comprising a plug connector and socket connector having the above described advantages.

What is claimed is:

1. A plug connector comprising a counter connector fitting portion to be connected to a counter connector responsive to movement along a first direction, said connector fitting portion being provided at one end of an insulator, and an FPC fitting portion to be connected to an FPC or FFC also responsive to movement along the first direction, said FPC fitting portion being elongated along a second direction intersecting said first direction at the other end of the insulator, said FPC fitting portion having a plurality of contact groups disposed within said insulator, each of said contact groups having a pair of two first plug contacts arranged in said second direction and a second plug contact for transmitting a ground signal between said pair of first contacts, said pair of first and said second plug contacts being plate springs for making contact to said FPC or FFC responsive to movement in a third direction intersecting said first and said second directions, said one end of said insulator being formed into a plate shape at one end, each of said first plug contacts having an extending portion extending in the first direction on said one end of said insulator, said counter connector fitting portion being in the form of a plate which comprises said extending portion, said counter connector fitting portion having a non-pin structure.

2. The plug connector according to claim 1, wherein each of said second plug contacts has a surface contact portion in the FPC fitting portion and a connecting portion connected to a ground plate opposite to said surface contact portion, said surface contact portion and said ground plate sandwiching the FPC to contact with ground patterns formed on one surface and another surface of the FPC, respectively, whereby transmissions of ground signals are performed reliably and substantially perfectly.

3. The plug connector according to claim 1, further comprising on its periphery a shell slidably movable in said first direction, wherein said shell has a slider portion for moving said FPC in said first direction so as to place the FPC in contact with said contact groups when the FPC is connected.

4. The plug connector according to claim 3, wherein said shell comprises means for resisting loosening for preventing said FPC from being loosened when it is connected.

5. The plug connector according to claim 4, further comprising a locking means for preventing said FPC from being loosened, wherein said locking means has a protrusion portion projecting in said second direction of said insulator and a spring portion have a hole at a location on said shell corresponding to the protrusion portion of said insulator, said locking means also being formed so as to be easily releasable responsive to a use of a jig.

6. The plug connector according to claim 3, wherein said shell is formed by a part which is integral with said slider portion.

7. The plug connector according to claim 6, wherein said slider portion is made of sheet-like electrically conductive material formed by a single part.

8. The plug connector according to claim 1, wherein each of said second plug contacts has a surface contact portion in a FPC fitting portion and a connecting portion connected to a ground plate opposite to said surface contact portion, said surface contact portion and said ground plate sandwiching the FPC to contact with ground patterns formed on one surface and another surface of the FPC, respectively, whereby transmissions of ground signals are performed reliably and substantially perfectly.

9. The socket connector as claimed in claim 8, wherein said first socket contact has a contact portion for making a resilient contact with the counter connector's signal contact and has a solder terminal portion for soldering to a substrate and said second socket contact containing a contact portion of the ground plate for resiliently contacting the counter connector's ground contact, said ground plate further having a solder terminal portion for soldering to a substrate.

10. The socket connector as claimed in claim 9, wherein said first socket contact has a narrow sheet-like structure.

11. The socket connector as claimed in claim 9, wherein the ground plate thereof comprises the contact portion having the same resilience as the first socket contact and the solder terminal portion which is solderable to the substrate like the soldering terminal portion of the first socket contact, the contact portion and the soldering terminal portion of the socket connector being formed by punching a single sheet.

12. The socket connector as claimed in claim 11 further having a conductive shell therearound, said ground plate being in contact with the counter connector's ground contact through one side of the contact portion and further in contact with the shell through the other side of the contact portion.

13. The socket connector as claimed in claim 12, wherein said shell has a folding portion at the first counter connector fitting portion and a cutout portion for accommodating the contact portion of the ground plate.

14. A socket connector assembly comprising: a socket connector with a first counter connector fitting portion connected to a second counter connector, said socket connector having a substrate connecting portion to be soldered onto a substrate;

said second counter connector having a counter connector's contact, provided in a second counter connector fitting portion thereof to be connected to the first counter connector fitting portion;

said first counter connector fitting portion containing a first socket contact and a second socket contact coming into contact with said second counter connector's contact, the first and second socket contacts being disposed to enclose said second counter connector fitting portion in a direction perpendicular to a first direction such that said first and second contacts oppose each other.

15. A high speed transmission connector comprising a plug connector and a socket connector connected to each other responsive to movement along a first direction, said plug connector comprising a socket connector fitting portion at an end of an insulator so as to be connected to the socket connector responsive to movement along the first direction and an FPC fitting portion elongated along a second direction perpendicular to the first direction at the other end of the insulator which is to be connected to an FPC or an FFC along the first direction, said socket connector comprising a plug connector fitting portion to be connected to the plug connector responsive movement along the first direction and a substrate connecting portion adapted to be soldered onto a substrate;

said FPC fitting portion containing a plurality of contacts each comprising a pair of first plug contacts arrange along said second direction and a second plug contact disposed between the pair of contacts for sending a ground signal, both plug contacts being disposed in the insulator and being adapted to make contact with said FPC or FFC in a third direction perpendicular to said first and second direction;

said plug connector containing a plug side signal contact and a plug side ground contact, both side contacts being provided at the socket connector fitting portion to be connected to the plug connector fitting portion, said plug connector fitting portion having a plurality of first socket contacts each coming into contact with the plug side ground contact;

said first and second socket contacts being disposed to enclose the socket connector fitting portion along a direction perpendicular to the first direction such that said first and second contacts oppose each other;

said substrate connecting portion having a plurality pairs of signal contacts elongated from said plurality of first socket contacts and a plurality of ground contacts elongated from said plurality of second socket contacts and disposed between two pairs of signal contacts being adjacent to each other.

16. The high speed transmission connector as claimed in claim 15, wherein said first socket contact has a contact portion for resiliently contacting the counter connector's signal contact and a solder terminal portion to be soldered onto a substrate, said second socket contact containing a contact portion of the ground plate for resiliently contacting with the counter connector's ground contact, said ground plate further having a solder terminal portion to be soldered to a substrate.

17. The high speed transmission connector as claimed in claim 15, wherein said second plug contacts are formed on a ground plate formed of a single conductive plate.

18. The high speed transmission connector as claimed in claim 17, wherein said first plug contact has an extending portion extending along the first direction, said counter connector fitting portion having a sheet-like structure comprises said extending portion, said insulator and said ground plate opposing said extending portion via said insulator in a third direction perpendicular to the first and second directions.

19. A plug connector comprising a counter connector fitting portion to be connected to a counter connector responsive to movement along a first direction, said connector fitting portion being provided at one end of an insulator, and an FPC fitting portion to be connected to an FPC or FFC also responsive to movement along the first direction, said FPC fitting portion being elongated along a second direction intersecting said first direction at the other end of the insulator, said FPC fitting portion having a plurality of contact groups disposed within said insulator, each of said contact groups having a pair of two first plug contacts arranged in said second direction and a second plug contact for transmitting a ground signal to between said pair of first contacts, said pair of first and second plug contacts being plate springs for making contact to said FPC or FFC responsive to movement in a third direction intersecting said first and said second directions, said one end of said insulator being formed into a plate shape at one end, each of said first plug contacts having an extending portion extending in the first direction on said one end of said insulator, said counter connector fitting portion being in the form of a plate which comprises said extending portion, said counter connector fitting portion having a non-pin structure, a conductive plate and second plug contacts being formed with a single ground plate, said extending portion of said first plug contacts being disposed on one surface of said counter connector fitting portion, said ground plate being extended opposed to said extending portion through said insulator and disposed on another surface of the connector fitting portion.

* * * * *

UNITED STATES PATENT AND TRADEMARK OFFICE

CERTIFICATE OF CORRECTION

PATENT NO. : 6,315,616 B1
DATED : November 13, 2001
INVENTOR(S) : Koji Hayashi

It is certified that error appears in the above-identified patent and that said Letters Patent is hereby corrected as shown below:

Column 1,
Line 51, delete “complicate” and insert -- complicated --;

Column 3,
Line 46, delete “provides” and insert -- provided --;

Column 5,
Line 22, delete “shall” and insert -- shell --;

Column 6,
Line 21, delete “portion--85” and insert -- portion 85 --;
Line 31, delete “69” and insert -- 67 --;
Line 45, delete “FPC Further” and insert -- FPC.Further --;

Column 7,
Line 9, delete “85” and insert -- 75 --;
Line 46, delete “is” and insert -- are --;

Column 8,
Line 26, delete “plug connector 21” and insert -- plug connector 63 --;

Column 9,
Line 34, delete “signal” and insert -- signals --;

Column 10,
Line 32, delete “35c”.

Signed and Sealed this

Seventeenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,315,616 B1
DATED : November 13, 2001
INVENTOR(S) : Koji Hayashi

It is certified that error appears in the above-identified patent and that said Letters Patent is hereby corrected as shown below:

Column 12,
Line 18, cancel beginning with "8. The plug connector" to and including "substantially perfectly." in line 26. and insert the following claim:

Claim 8. A socket connector assembly comprising:

a first counter connector fitting portion to be connected to a second counter connector, along a first direction and a substrate connecting portion to be soldered onto a substrate;

said first counter connector having a counter connector's contact, provided in said second counter connector fitting portion thereof to be connected to the first counter connector fitting portion;

said first counter connector fitting portion containing a first socket contact and a second socket contact coming into contact with said first counter connector's contact, the first and second socket contacts being disposed to enclosed said second counter connector fitting portion in a direction perpendicular to a first direction such that said first and second contacts oppose each other.

Line 55, cancel beginning with "14. A socket connector" to and including "each other." in column 13, line 6, and insert the following claim:

Claim 14. The socket connector as claimed in claim 8, wherein said counter connector's contact has a counter's signal contact and a counter connector's ground contact, provided in a second counter connector fitting portion thereof to be fit to the first counter connect or fitting portion; and wherein said first socket contact and said second socket contact come into contact with said counter connector's signal contact and said counter connector's ground contact, respectively.

Column 13,
Line 8, insert -- to be -- after "socket connector" and
Line 22, delete "arrange" and insert -- arranged --

Signed and Sealed this

Fourteenth Day of December, 2004

JON W. DUDAS
*Director of the United States Patent and Trademark Office*

US006315616C1

(12) EX PARTE REEXAMINATION CERTIFICATE (7543rd)

United States Patent
Hayashi

(10) Number: US 6,315,616 C1
(45) Certificate Issued: Jun. 1, 2010

(54) PLUG CONNECTOR AND SOCKET CONNECTOR

(75) Inventor: Koji Hayashi, Tachikawa (JP)

(73) Assignee: Japan Aviation Electronics Industry, Limited, Shibuya-Ku, Tokyo (JP)

Reexamination Request:
No. 90/009,131, May 5, 2008
No. 90/009,160, Jun. 11, 2008

Reexamination Certificate for:

| | |
|---|---|
| Patent No.: | **6,315,616** |
| Issued: | **Nov. 13, 2001** |
| Appl. No.: | **09/239,660** |
| Filed: | **Jan. 29, 1999** |

Certificate of Correction issued Dec. 14, 2004.

(30) Foreign Application Priority Data

Jan. 30, 1998 (JP) ..... 10-019568
Aug. 21, 1998 (JP) ..... 10-235225

(51) Int. Cl.
*H01R 25/00* (2006.01)

(52) U.S. Cl. ..... 439/638; 439/108

(58) Field of Classification Search ..... None
See application file for complete search history.

(56) References Cited

U.S. PATENT DOCUMENTS

| | | | | | |
|---|---|---|---|---|---|
| 3,486,159 | A | * | 12/1969 | Benjamin | 439/77 |
| 4,248,491 | A | * | 2/1981 | Mouissie | 439/495 |
| 4,647,136 | A | * | 3/1987 | Kinoshita et al. | 439/571 |
| 4,710,133 | A | * | 12/1987 | Lindeman | 439/92 |
| 4,822,303 | A | * | 4/1989 | Nakamura et al. | 439/607 |
| 5,073,130 | A | * | 12/1991 | Nakamura | 439/607 |
| 5,399,105 | A | * | 3/1995 | Kaufman et al. | 439/609 |
| 5,478,260 | A | * | 12/1995 | Kaufman et al. | 439/609 |
| 5,542,851 | A | * | 8/1996 | Chikano | 439/108 |

* cited by examiner

*Primary Examiner*—Margaret Rubin

(57) ABSTRACT

Plug and socket connectors, which are connected to each other along a first direction, constitute a high speed transmission connector, as for a notebook computer, for example. The connectors interconnect a printed circuit board (PCB) and a flexible printed circuit (FPC). The FPC fitting portion is a socket at the end of an insulator which is to be connected to the FPC. The PCB fitting portion comprises a plug connector which is to be connected to the socket connector and to a PCB connecting portion. The plug connector fitting portion has first and second contacts which come into contact with the plug side signal contact and the plug side ground contact, respectively, and enclose the socket connector fitting portion along a direction perpendicular to the first direction opposing each other along a direction perpendicular on the first direction.

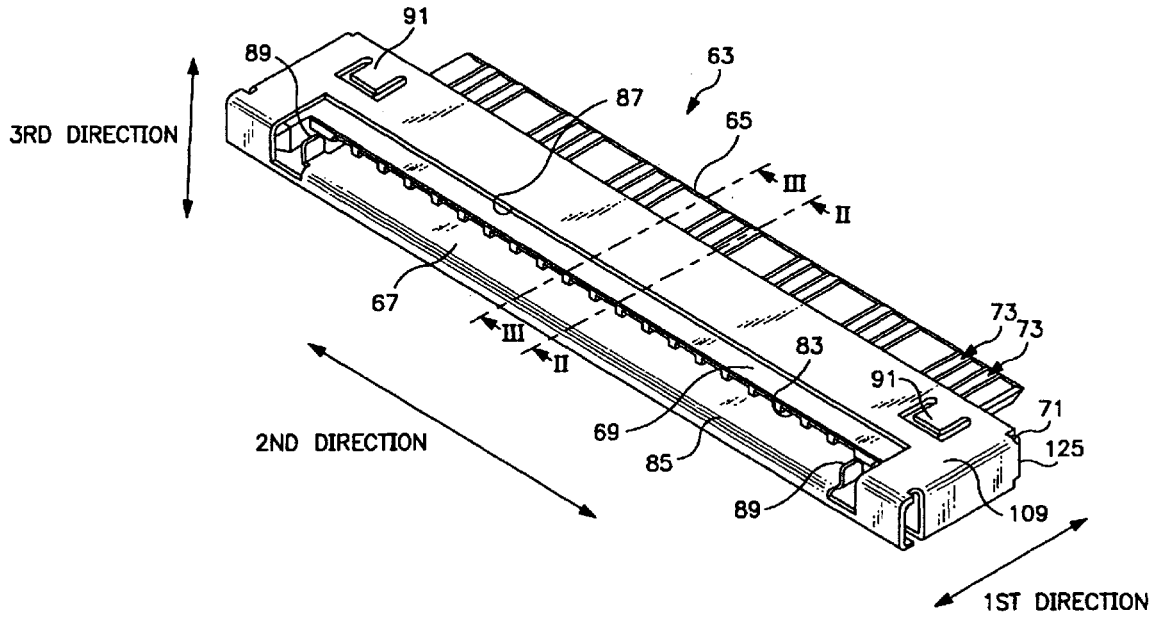

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 3 and 4 is confirmed.

Claim 9 is cancelled.

Claims 8, 10 and 11 are determined to be patentable as amended.

Claims 12, 13 and 14, dependent on an amended claim, are determined to be patentable.

Claims 2, 5-7 and 15-19 were not reexamined.

8. A socket connector assembly comprising:

a first counter connector fitting portion to be connected to a [second] counter connector, along a first direction and a substrate connecting portion to be soldered onto a substrate;

said [first] counter connector having a counter connector's contact, provided in [said] *a* second counter connector fitting portion thereof to be connected to the first counter connector fitting portion;

said first counter connector fitting portion containing a first socket contact and a second socket contact coming into contact with said [first] counter connector's contact, the first and second socket contacts being disposed to enclosed said second counter connector fitting portion in a direction perpendicular to a first direction such that said first and second contacts oppose each other,

*wherein said first socket contact has a contact portion for making a resilient contact with the counter connector's signal contact and has a solder terminal portion for soldering to a substrate and said second contact containing a contact portion of the ground plate for resiliently contacting the counter connector's ground contact,*

*said ground plate further having a solder terminal portion for soldering to a substrate.*

10. The socket connector as claimed in claim [9] *8*, wherein said first socket contact has a narrow sheet-like structure.

11. The socket connector as claimed in claim [9] *8*, wherein the ground plate thereof comprises the contact portion having the same resilience as the first socket contact and the solder terminal portion which is solderable to the substrate like the soldering terminal portion of the first socket contact, the contact portion and the soldering terminal portion of the socket connector being formed by punching a single sheet.

* * * * *

US006315616C2

(12) EX PARTE REEXAMINATION CERTIFICATE (8328th)

United States Patent
Hayashi

(10) Number: US 6,315,616 C2
(45) Certificate Issued: Jun. 14, 2011

(54) PLUG CONNECTOR AND SOCKET CONNECTOR

(75) Inventor: Koji Hayashi, Tachikawa (JP)

(73) Assignee: Japan Aviation Electronics Industry, Limited, Shibuya-Ku, Tokyo (JP)

Reexamination Request:
No. 90/009,768, Jul. 17, 2010

Reexamination Certificate for:

| | |
|---|---|
| Patent No.: | **6,315,616** |
| Issued: | **Nov. 13, 2001** |
| Appl. No.: | **09/239,660** |
| Filed: | **Jan. 29, 1999** |

Reexamination Certificate C1 6,315,616 issued Jun. 1, 2010

Certificate of Correction issued Sep. 17, 2002.

Certificate of Correction issued Dec. 14, 2004.

(30) Foreign Application Priority Data

Jan. 30, 1998 (JP) ..... 10-019568
Aug. 21, 1998 (JP) ..... 10-235225

(51) Int. Cl.
*H01R 12/00* (2006.01)

(52) U.S. Cl. ..... 439/66

(58) Field of Classification Search ..... None
See application file for complete search history.

(56) References Cited

U.S. PATENT DOCUMENTS 4,773,878 A * 9/1988 Hansell, III ..... 439/497
5,860,814 A * 1/1999 Akama et al. ..... 439/74

FOREIGN PATENT DOCUMENTS

EP 454278 * 10/1991
JP 07-161415 * 6/1995

* cited by examiner

*Primary Examiner*—Pia Tibbits

(57) ABSTRACT

Plug and socket connectors, which are connected to each other along a first direction, constitute a high speed transmission connector, as for a notebook computer, for example. The connectors interconnect a printed circuit board (PCB) and a flexible printed circuit (FPC). The FPC fitting portion is a socket at the end of an insulator which is to be connected to the FPC. The PCB fitting portion comprises a plug connector which is to be connected to the socket connector and to a PCB connecting portion. The plug connector fitting portion has first and second contacts which come into contact with the plug side signal contact and the plug side ground contact, respectively, and enclose the socket connector fitting portion along a direction perpendicular to the first direction opposing each other along a direction perpendicular on the first direction.

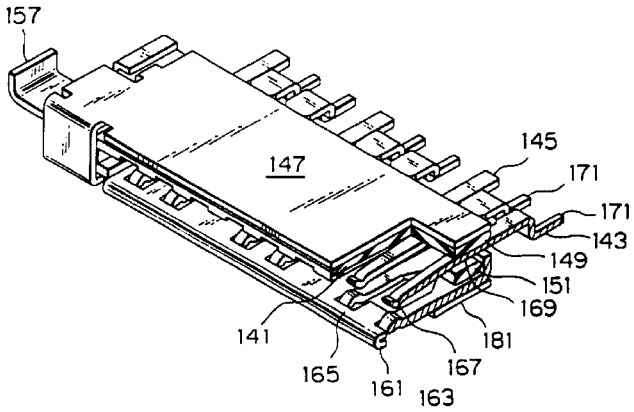

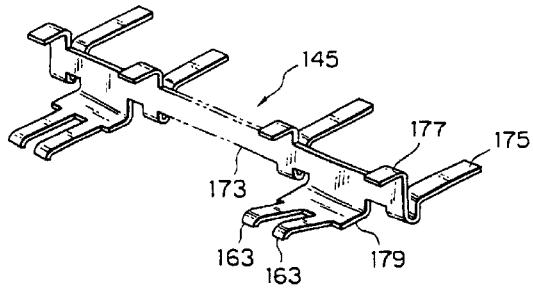

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 9 was previously cancelled.

Claims 8 and 14 are determined to be patentable as amended.

Claims 10 and 11, dependent on an amended claim, are determined to be patentable.

Claims 1-7, 12, 13 and 15-19 were not reexamined.

8. A socket connector assembly comprising:

*an insulator;*

*a shell provided around the insulator, the shell being provided with a substrate fixing portion to be soldered onto a substrate; and* a first counter connector fitting portion to be connected to a counter connector[.] along a first direction and a substrate connecting portion to be soldered onto a substrate*, said first counter connector fitting portion being disposed within the insulator*;

said counter connector having a counter connector's contact, provided in a second counter connector fitting portion thereof, to be connected to the first counter connector fitting portion;

said first counter connector fitting portion containing a first socket contact and a second socket contact coming into contact with said counter connector's contact, the first and second socket contacts being disposed to [enclosed] *enclose* said second counter connector fitting portion in a direction perpendicular to a first direction such that said first and second contacts oppose each other, wherein said first socket contact has a *resilient* contact portion for making a resilient contact with the counter connector's signal contact and has a solder terminal portion for soldering to a substrate and said second socket contact containing a *resilient* contact portion of the ground plate for resiliently contacting the counter connector's ground contact, said ground plate further having a solder terminal portion for soldering to a substrate.

14. The socket connector as claimed in claim 8, where said counter connector's contact has a counter *connector's* signal contact and a counter connector's ground contact, provided in [a] *the* second counter connector fitting portion thereof to be fit to the first counter connector fitting portion; and wherein said first socket contact and said second socket contact come into contact with the said counter connector's signal contact and said counter connector's ground contact, respectively.

* * * * *